United States Patent [19]

Gualandris et al.

[11] Patent Number: 4,859,909

[45] Date of Patent: Aug. 22, 1989

[54] PROCESS AND APPARATUS FOR IGNITING AN ULTRA-HIGH FREQUENCY ION SOURCE

[75] Inventors: Renë Gualandris, Aix en Provence; Paul Ludwig, Grenoble; Jean-Claude Rocco, Claix; Francois Zadworny, Corenc, all of France

[73] Assignee: Commissariat A L'Energie Atomique, Paris, France

[21] Appl. No.: 129,853

[22] Filed: Dec. 7, 1987

Related U.S. Application Data

[63] Continuation of Ser. No. 793,915, Nov. 1, 1985.

[30] Foreign Application Priority Data

Nov. 6, 1984 [FR] France ..... 84 16884

[51] Int. Cl.[4] ..... H05H 13/00

[52] U.S. Cl. ..... 315/111.81; 315/39; 313/230; 313/231.31

[58] Field of Search ..... 315/111.21, 111.81, 315/111.91, 39; 313/230, 359.1, 231.31; 250/423 R, 423 F

[56] References Cited

U.S. PATENT DOCUMENTS 3,778,656 12/1973 Fremot et al. ..... 315/111.1
4,507,588 3/1985 Asmussen et al. ..... 315/39
4,598,231 7/1986 Matsuda et al. ..... 315/39

FOREIGN PATENT DOCUMENTS 2174678 10/1973 France .

OTHER PUBLICATIONS

*Nuclear Instruments & Methods In Physics Research,* vol. 196, No. 2/3, May 1982, pp. 325–329.
*Applied Physics Letters,* vol. 44, No. 4, Feb. 1984, pp. 396–398.
*Revue De Physique Appliquee,* vol. 12, No. 10, Oct. 1977, pp. 1655–1661.

*Primary Examiner*—James J. Groody
*Assistant Examiner*—Mark R. Powell
*Attorney, Agent, or Firm*—Nutter, McClennen & Fish

[57] ABSTRACT

A process for igniting a ultra-high frequency ion source using in a per se known manner, a resonator cavity supplied by a gas or a vapor of a material for forming a plasma, a system for injecting ultra-high frequency power into the cavity and a system for extracting ions of the plasma outside of the cavity, said process comprising the steps of forming the cavity to be of the multi-mode type, producing nucleating electrons within the medium to be ionized and preserving the plasma following its ignition solely by ultra-high frequency power. Apparatus for igniting an ultra-high frequency ion source using the process is also disclosed.

7 Claims, 2 Drawing Sheets

PROCESS AND APPARATUS FOR IGNITING AN ULTRA-HIGH FREQUENCY ION SOURCE

This application is a continuation of Ser. No. 793,915 filed Nov. 1, 1985.

BACKGROUND OF THE INVENTION

The present invention relates to the field of ultra-high frequency ion sources, usable both in electron sources and in plasma generators.

It has numerous applications in the field of the sputtering of thin films, microetching, ion implantation, electron irradiators, heating by a beam of fast neutral particles of the plasma of thermonuclear reactors, tandem accelerators, synchrocyclotrons as well as in surface cleaning and treatment.

Hitherto ultra-high frequency ion sources have been based on the principle of electron cyclotron resonance ion sources. In such known sources, the ionization of a neutral gas and the appearance of a plasma are brought about by combining in an hf cavity, the synergetic effects of an ultra-high frequency electromagnetic field of frequency F and a constant magnetic field B, so as to obtain resonance in said latter frequency and the pulsation $\omega = eB/m$ of the electrons in their circular paths around the force lines of field B. Thus, this condition is written: $F = eB/2\pi m$, in which e and m are the electron charge and mass, B the constant magnetic field present in the cavity and which gives the relation linking f and B to obtain electron cyclon resonance within the plasma. The electrons then describe spiral paths around the force lines of field B by absorbing the energy of said field and by thus acquiring a maximum kinetic energy for bringing about ionization by impacts of the neutral gas molecules present in the source hf cavity.

Such ion sources are described by R. Geller, C. Jaquot and P. Sermet in "Proceedings of the symposium on ion sources and formation of ion beams", Berkeley, October 1974 and F. Bourg, R. Geller, B. Jacquot, T. Lamy, M. Pontonnier and J. C. Rocco in "Nuclear instruments and methods", North-Holland Publishing Company, 196, 1982, pp. 325–329. They are based on establizhing a confinement of the plasma with the aid of a mirror magnetic configuration and maximum values of the magnetic field B higher than the value ensuring electron cyclotron resonance.

The correct operation of such known ion sources still requires certain special precautions, and involves a high electrical energy consumption, particularly for producing constant magnetic fields, for bringing about the electron cyclotron resonance and for the extraction of the ions. Thus, for example, in a known ion source of this type, the maximum and minimum magnetic induction values are 0.42 and 0.32 Tesla respectively, and electron cyclotron resonance takes place at 0.36 Tesla, the frequency of the high frequency wave injected being fixed at approximately 10 GHz.

Thus the ions produced in the plasma are extracted by an extraction system constituted by electrodes raised to d.c. potentials and which are downstream of the maximum of the magnetic field. Under these conditions, ion current emitted by the source decreases in proportion to the value of the field of the extraction point and, to obtain an intense ion current, it is necessary to extract the ions in a magnetic field at least of the same order of magnitude as the cyclotron resonance field.

This necessity is unfortunately incompatible with a good optical quality of the extracted ion beam on cancalling out the magnetic field prior to the impact of the ions in the utilization zone. Thus, in this case the ions take on transverse energy, the beam diverges and its optical qualities are reduced, in accordance with the effect described in the Bush theorem.

In order to retain the optical qualities of the beam downstream of the ion source, it is then necessary to keep the magnetic field constant throughout the drift space of the ion beam, up to the point of its application for the transformation of the ions into neutral particles. For the example described hereinbefore, the field to be kept constant corresponds to an inducation of approximately 0.36 Tesla and the electrical power consumed by the coils producing this magnetic field is approximately 1 megawatt.

In the case of using low energy ions, (below 1 kev) the extraction system does not make it possible to extract the high densities. In order to increase the latter, it is possible to compress the ion beam downstream of the ion source. In order to compress the ion beam, the magnetic field must be incresed in proportion thereto. The increase in the current density of the ions obtained is consequently limited by the technical problems occurring with respect to the production of magnetic fields with this order of magnitude.

Thus, in summarizing, the ion sources according to the prior art have the main disadvantages of a very high energy consumption for establishing the magnetic configuration, whilst the increase in the density of the low kinetic energy ion current is problematical, due to the need of a high magnetic field for transferring the latter downstream of the extraction to the place of use.

In order to obviate these disadvantages, a number of solutions have been proposed, such as e.g. that described in French patent application No. 83 08401 of the Commissariat a l'Energie Atomique of May 20th 1983.

In this unpublished French application, the magnetic confinement configuration has been modified in order to permit the extraction of ions in a magnetic field much smaller than that of the prior art sources. This has led to a considerable economy with respect to the energy required for producing the magnetic configuration in the source and also downstream of the extraction, during low energy transfer of the extracted beam.

However, the ion source described in this patent application still uses electron cyclotron resonance for producing the plasma in the cavity, so that it still requires therein the presence of a magnetic field, which is higher or at least equal to that producing the electron cyclotron resonance.

SUMMARY OF THE INVENTION

The present invention relates to a process for igniting an ultra-high frequency ion source which operates without having recourse to electron cyclotron resonance and consequently without the presence of a constant magnetic field for this purpose of the hf cavity.

This process for igniting an ultra-high frequency ion source using in per se known manner a resonator cavity supplied by a gas or vapor of a material for forming a plasma, a system for injecting an ultra-high frequency power into the cavity and a system for extracting the ions from the plasma outside the cavity is characterized in that as the cavity is of the multimode type, within the medium to be ionized, are produced electron nuclei and the plasma is preserved following its ignition with the aid of the ultra-high frequency power only.

The essential novelty provided by the present invention is based on the fact that, unlike in the prior art, it has been possible to produce an ultra-high frequency ion source functioning with the aid of a resonator caity and without using the electron cyclotron resonance phenomenon, i.e. without a constant magnetic field within said cavity, in other words, it has been found that it was possible, once a plasma had been ignited, to keep it active solely with the aid of the ultra-high frequency power injected into the resonator cavity.

This unexpected result makes it possible to produce much simpler ultra-high frequency ion sources than in the prior art and which are, in particular, much more economic due to the elimination of the high electric power consumption hitherto required through the presence of a magnetic field for producing electron cyclotron resonance conditions.

According to the invention, the ignition of the ion source by producing electron nuclei within the medium to be ionized can take place either once and for all during the initial ignition, or in a repetitive manner, i.e. whenever the need arises, or even in a permanent manner, which is rarely indispensable.

It should be noted that a single ignition enables the source to operate under pulsating conditions for a recurrence time of approximately 100 milliseconds.

According to the envisaged applications, an axial and/or multipolar magnetic configuration may still be necessary and used for confining and homogenizing the plasma, but this case the values of the magnetic fields are well below those previously necessary for producing electron cyclotron resonance conditions.

According to another feature of the ignition process according to the invention, the formation of electron nuclei within the medium to be ionized is obtained by direct electron seeding.

According to another variant, these electron nuclei are obtained by the temporary, local application of a magnetic field having an adequate intensity for producing within a small volume of the cavity, the conditions for establishing electron cyclotron resonance, which in turn leads to the formation of the plasma.

According to another variant of the present process, the electron nuclei are formed within the medium to be ionozed by the temporary application of an overpressure to the cavity.

The invention also relates to an apparatus for igniting an ultra-high frequency source for performing the process described hereinbefore, particularly simple and which uses easily employed known means.

According to a first embodiment of the invention, this apparatus for igniting an ultra-high frequency ion source using in per se known manner a multimode resonator cavity supplied by a gas or a vapour of a material intended for forming a plasma, a system of injecting an ultra-high frequency power into the cavity and a system for extracting ions from the plasma out of the cavity is characterized in that it is constituted by an electromagnet surrounding the outer cavity wall, a few centimeters downstream of the injection system and whereof the magnet casing is applied to said cavity.

The ignition process is performed by means of this electromagnet located against the cavity wall and this consists of producing in a temporary, local manner in a small volume of the cavity the conditions for establishing an electron cyclotron resonance which, in turn, leads to the formation of the plasma.

According to other embodiments of the ignition apparatus for an ultra-high frequency ion source according to the invention, the electron nuclei within the medium to be ionized are produced by one of the means chosen from the group including heated filaments, field emission points, spark sources, ionization gauges, etc., the apparatus chosen being applied to the interior of the cavity or through the wall thereof.

Finally, according to the invention, each of the three dimensions of the resonator cavity, namely length, width and height, must exceed the small side or diameter of the waveguide of the cavity high frequency power injection system. This condition is necessary in order to be able to obtain the ignition and self-preserving of a plasma, within a multimode resonator cavity having said special shape and very widely used.

Obviously, the ultra-high frequency ion sources performing this ignition process can be of a random known nature and can in particular, like other sources, have variants or improvements of detail as referred to hereinbefore.

Thus, for example, such a source can have a magnetic configuration, downstream of the system for extracting ions from the plasma or electrons for producing under good conditions, the transfer of the extracted beam even for obtaining its radial compression.

In other variants, the ion or electron extraction system can be constituted by a single electrode raised to a given potential.

Finally, according to other features used in a preferred but non-obligatory manner, the apparatus for igniting the ultra-high frequency ion source is located at a distance of a few centimeters downstream of the junction zone between the ultra-high frequency injector and the ion source cavity. This location has proved to be advantageous for obtaining a good ignition under maximum efficiency conditions.

In the same way, it is advantageous for the injection of the gas or vapor of material which it is wished to ionize upstream of the ion or electron extraction system and in the vicinity thereof, i.e. at a relatively small distance therefrom.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
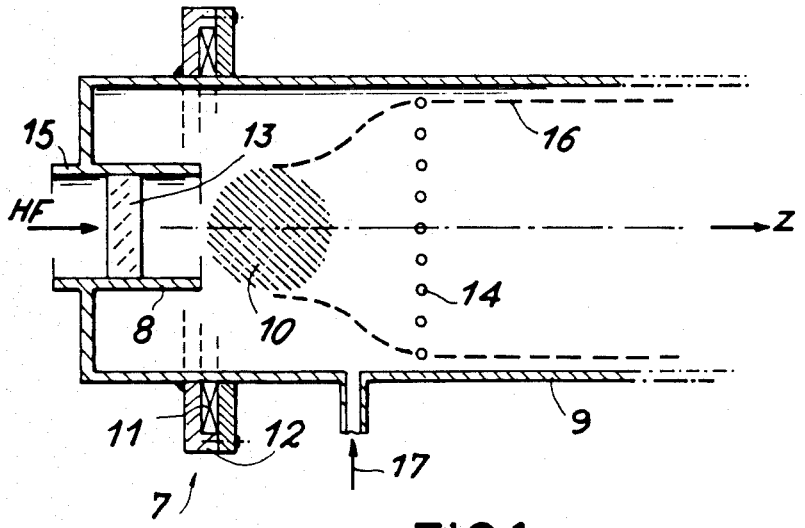
FIG. 1 an axial section of an ultra-high frequency resonator cavity ion source equipped with an ignition apparatus according to the invention.

According to the invention, FIG. 1 diagrammatically shows in a simplified manner an embodiment of an ultra-high frequency plasma, electron or ion source, in crosssection along the central axis Z of the source.

In a vacuum cavity 9, e.g. shaped like a cylinder of revolution, one of the ends carries an injector 8 for injecting ultra-high frequency power through a window 13 and the other end is connected to the place of use of the ions, electrons or plasma. According to the invention and as shown in FIGS. 1 and 2, the revolution waveguide 15 has a diameter smaller than that of cavity 9.

It should be noted that cavity 9 can have a random shape, as a function of the nature of the use. In particular, the ultra-high frequency power injector 8 can be constituted by several ultra-high frequency injectors in parallel.

Figure 2:
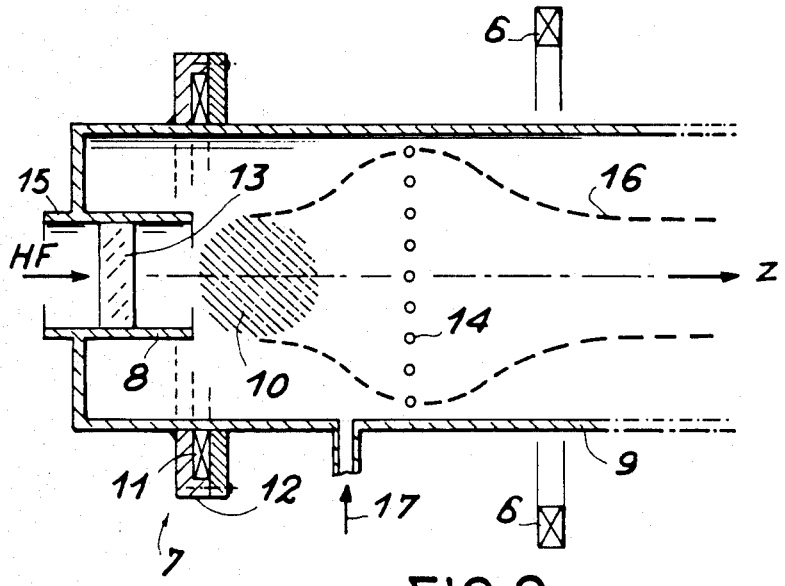
FIG. 2 an identical source to that of FIG. 1 on which has been placed a supplementary plasma compression coil downstream of the beam.

According to the invention, the relative dimensions of a source like that of FIGS. 1 and 2 with respect to the hf injector systems are not of a random nature, whereas cavity 9 is parallelepipedic. In this case, the dimensions of the three sides of the cavity 9 must be larger than the diameter or the small side of the waveguide injecting the hf power at 13, if it is wished to be able to ignite, and in particular preserve, the plasma 10 in the active state without having to have recourse to electron cyclotron resonance of said plasma.

At 17 is introduced a gas or vapor for forming a plasma under a low pressure of a few $10^{-3}$ to $10^{-2}$ Torr upstream of the ion extraction system 14 and in the vicinity thereof.

In multimode operation of the cavity, there is in fact a pressure gradient in the source, which increases from window 13 to the extraction point, hence the introduction of the gas to be ionized in the vicinity of the extraction point. The profile of the extracted ion beam is shown at 16 in FIGS. 1 and 2.

In another embodiment, the plasma can be produced at another point and then injected into cavity 9.

In this embodiment, the ignition system 7 is constituted by a circular electromagnet surrounding wall 9 and having an annular coil 11 and a soft iron casing 12 applied to wall 9. This electromagnet is able to ignite the discharge by a charging pulse, by locally and temporarily producing within the cavity a magnetic field producing electron cyclotron resonance conditions and the plasma is ignited at 10. The ion or electron extraction system is here represented in the form of a single electrode 14.

On increasing the ultra-high frequency power per volume unit, the ion current increases. It is then possible to extract larger ion currents, to reduce the dimensions of the cavity, which makes it possible to use minicavities with a limited ultra-high frequency power consumption.

The absence in an ion source of this type of the high magnetic field for producing and preserving an electron cyclotron resonance phenomenon leads to very considerable energy savings, which is the major advantage of the present invention.

The beam extracted from the source could be compressed downstream of the extraction electrodes, as shown by the profile 16 in FIG. 2 by the application of a supplementary magnetic field, which is e.g. the case of coil 15 in the example of FIG. 2.

In an exemplified manner, an ion source according to the invention has operated without a cyclotron resonance magnetic field under the following conditions:

oscillator 2.45 GHz,
fixed hf power 1 kW,
source volume 1 $dm^3$,
$N_2$-P gas $5.10^{-4}$ mbar,
electron density $n_e$ $2.10^{11}/cm^3$,
electron temperature $T_e=6$ eV,
cutoff density $n_e=7.10^{10}$, i.e. a value which cannot be reached in a monomode ECR source at this frequency and for this gas.

Figure 3A:
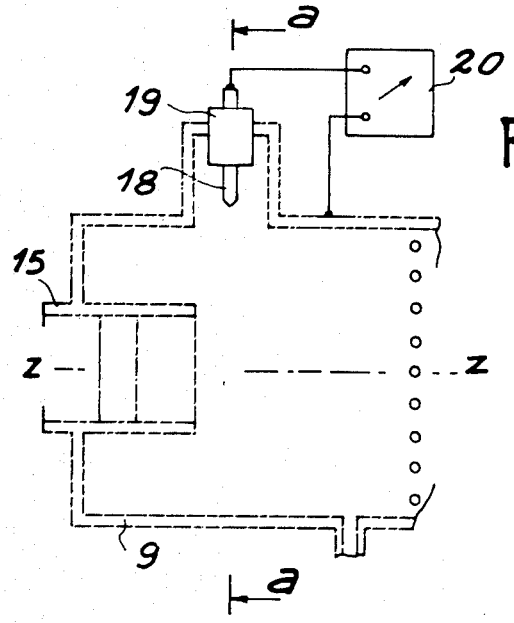
FIG. 3*a* in section along axis Z of the ion source and in FIG. 3*b*, as a cross-sectoion along a—a of the same apparatus.

FIG. 3 shows an ion source according to the invention equipped with a randomly shaped, preferably pointed, spark gap switch 18, which is insulated from ion source 9 by an insulator 19 and which is polarized by means of a power supply 20 with respect to said same ion source 9.

Power supply 20 can be a.c. (transformer) or d.c. and in this case point 18 is raised to a negative potential with respect to source 9.

Figure 3B:
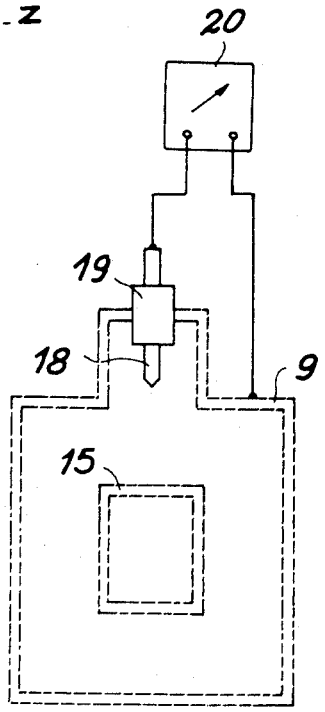
FIG. 3 an example of an ion source equipped with an ignition apparatus in the form of a field emission point.

The a.c. or d.c. potential difference is a few kilovolts, but it is dependent on the pressure and the distance d between the point and the most remote wall of the source. When the ion source 9 is rectangular, it is preferable to place the point on the small side of said source 9 (FIG. 3*b*). The igniter in question operates according to the glow discharge principle. In a variant, there can be two points and the potential difference is applied between them. A source according to FIG. 3, e.g. operates with the followig parameters:

$P \simeq 5.10^{-4}$ mbar,
$d \simeq 5$ cm,
V a.c.$\simeq$3000 V,
pulse length$\lesssim$1 s.

Figure 4:
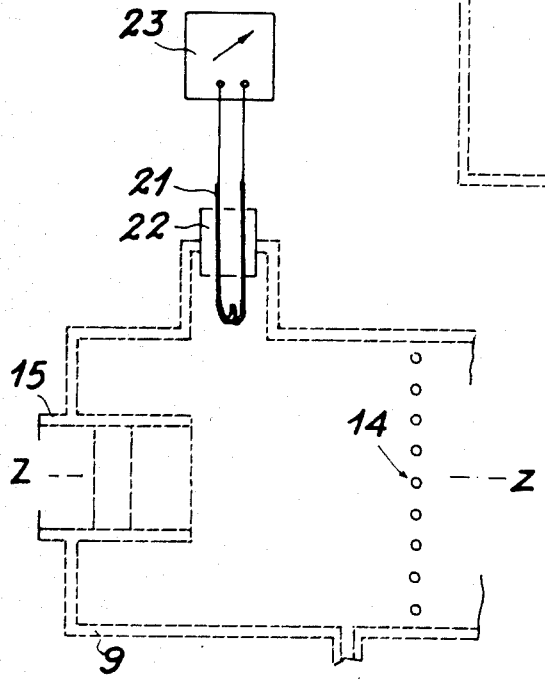
FIG. 4 an example of an ion source provided with a heated filament.

In FIG. 4, source 9 has an electron-emitting refractory metal filament 21 (w, Mo, Ta) as the seeding nucleus producing means. Filament 21 passes through the source wall 9 in an insulator 22 and the filament heating power supply 23 is either a.c. or d.c.

Standard operating parameter values are $P \simeq 5.10^{-4}$ mbar with a filament 21 having a surface of a few $mm^2$ raised to approximately 2000° C. for approximately 1 second.

In conclusion, it can be stated that the reduction or complete suppression of the magnetic confinement field at the source leads to a very significant energy saving when using coils or a considerable cost saving when using magnets. As a result of these magnetic and ultra-high frequency energy savings, the sources according to the invention have numerous important applications on high voltage platforms (Van de Graaff generator, synchrocyclotron, etc.), which was not the case with conventional electron cyclotron resonance sources.

What is claimed is:

1. An ignition device of an ultra-high frequency ion source using a resonant cavity having a random shape, supplied by a gas or a vapor of a material intended to form a plasma filling the cavity, a system having a waveguide for injecting ultra-high frequency power into the cavity and a system for extracting ions from the plasma outside the cavity, wherein: each of the three dimensions of the plasma cavity, namely length, width and height or diameter and length exceeds the small side or diameter of the waveguide of the system for injecting ultra-high frequency power into the cavity; means are provided for injecting into the cavity gas or vapor of the material to be ionized upstream of the ion extraction system and at a relatively small distance from the latter compared with the length of the cavity in order to establish a pressure gradient in the source, said pressure rising from the ultra-high frequency power injection zone to the ion extraction zone; means are provided for producing within the medium to be ionized in a region of the cavity preferably located at a few centimeters downstream of the junction zone between the ultra-high frequency power injection system and the cavity, electron nuclei bringing about the ignition of the plasma having a random shape, the dimensions of the enclosure and the rising pressure of the injection system towards the extraction point then enabling the plasma to function under multimode operating conditions, i.e. without a privileged mode, and to self-maintain with the aid of the ultra-high frequency power alone, without having recourse to a permanent cyclotron resonance of the electrons of said plasma.

2. An ignition device according to claim 1, wherein the production of electron nuclei within the medium to be ionized takes place in a repetitive manner during operation under pulsed conditions.

3. An ignition device according to claim 1, wherein the production of electron nuclei within the medium to be ionized takes place all at once during the initial ignition, during the operation under pulsed conditions with a recurrence time of approximately 100 milliseconds.

4. An ignition device according to claim 1, wherein the production of electron nuclei within the medium to be ionized is obtained by direct seeding of electrons.

5. An ignition device according to claim 4, wherein the means for producing the electron nuclei within the medium to be ionized are chosen from the group consisting of heated filaments, field emission points, spark sources, ionization gauges, the chosen means being applied in the plasma cavity or through the wall thereof.

6. An ignition device according to claim 1, wherein the production of electron nuclei within the medium to be ionized is obtained by a temporary and local application of a magnetic field having a sufficient intensity to produce, in a small volume of the cavity, the conditions for establishing an electron cyclotron resonance, which brings about the creation of the plasma.

7. An ignition device according to claim 6, wherein the magnetic field for producing the establishment conditions for a temporary electron cyclotron resonance is obtained with the aid of an electromagnet surrounding the outer wall of the cavity at a few centimeters downstream of the injection system and whereof the magnet case is applied to the wall of said cavity.

* * * * *